United States Patent [19]

Kuhn

[11] Patent Number: 4,535,013

[45] Date of Patent: Aug. 13, 1985

[54] ADDITION OF RESINS TO LATEX BONDED NONWOVEN FABRICS FOR IMPROVED STRENGTH

[76] Inventor: Beryl M. Kuhn, 830 Sugar Creek Dr., Conyers, Ga. 30208

[21] Appl. No.: 523,493

[22] Filed: Aug. 15, 1983

[51] Int. Cl.[3] ..... B05D 3/02; C08L 93/04; C09J 7/00

[52] U.S. Cl. ..... 427/389.9; 156/308.2; 524/270; 524/271; 524/272; 524/274; 428/290

[58] Field of Search ..... 196/308.2; 524/270, 524/271, 272, 274; 427/389.9; 428/290

[56] References Cited

U.S. PATENT DOCUMENTS

| | | | |
|---|---|---|---|
| 3,865,770 | 2/1975 | Blake | 156/327 X |
| 3,970,623 | 7/1976 | Feeney et al. | 156/327 X |
| 4,221,226 | 9/1980 | Kiefer et al. | 131/267 |
| 4,276,111 | 6/1981 | Karim et al. | 156/308.2 X |
| 4,325,853 | 4/1982 | Acharya et al. | 524/272 |
| 4,356,229 | 10/1982 | Brodnyan et al. | 428/288 |
| 4,367,113 | 1/1983 | Karim et al. | 524/272 X |
| 4,404,299 | 9/1983 | De Croix | 524/77 |

*Primary Examiner*—Michael R. Lusignan

[57] ABSTRACT

A low temperature binder systen for non-woven polyolefin fabrics and corresponding method for increasing multidirectional web strength thereof whereby the corresponding fiber web is contacted by a system comprised of a copolymer or terpolymer modified with an active amount of a resin ester component of limited abietic acid concentration, of a hydrogenated resin and a glycerol or pentaerythritol, the latter having a specified softening point and molecular weight range.

19 Claims, No Drawings

ADDITION OF RESINS TO LATEX BONDED NONWOVEN FABRICS FOR IMPROVED STRENGTH

This invention relates to an improved method and binder system for preparation of non-woven polyolefin fabrics. In particular, it relates to the preparation of such fabrics comprising polyolefin staple fibers contacted with an improved low-temperature binder system.

BACKGROUND

Because of their relatively low cost and low density polyolefin fibers such as polypropylene are regarded as good candidate material for use in non-woven fabrics. In fact, polypropylene fibers have already found acceptance for such purpose as spun bonded, needle punched, and thermally bonded non wovens. In applications where multidirectional strength, particularly wet cross-directional strength, of the non-woven fabric is desired, however, the performance of polyolefin fiber webs leave something to be desired. This is particularly the case where the non-woven fabric is intended for use in contact with the human body, such as a diaper component or similar purpose, and where retention of good softness and absorptivity characteristics is important.

Generally speaking, cross directional strength of nonwovens depends upon (a) the weight and number of fibers in the web,
(b) the degree or amount of cross-orientation of such fibers due to manner of web formation;
(c) the nature, amount, and distribution of binder used to form the fiber web, and
(d) curing conditions, such as the utilization of heat.

Wet cross directional strength depends substantially upon the choice and amount of binder.

Latex-bonded non-woven fabrics are customarily composed of loosely assembled webs of synthetic fibers bound together at various points with an adhesive binder. In particular, the fiber web is obtained by carding or garnetting the fiber, followed by application of binder (usually as an aqueous solution, suspension, or dispersion) by using spray, print rolls or similar art-recognized means of application. The treated web is then dried and cured to obtain the desired non-woven fabric. This technique is customarily referred to as a "Dry Process".

Alternatively, aqueous fiber suspensions can be captured or applied onto a screen to form a wet sheet, binder being added initially to the fiber suspension and chemically precipitated onto the suspended fibers. These steps are customarily followed by using papermaking equipment such as Fourdriniers or Rotoformers, and the resulting sheet removed by vacuum transfer to a belt for drying and curing (i.e. "Wet Process").

Non-wovens formed by a Dry Process are preferred for many end products. Unfortunately, however, the Dry Process tends to minimize random orientation of fibers in favor of a general "machine" direction orientation. This results in a fabric tensile strength that is much lower in the "cross direction" then in the "Machine Direction". Cross direction tensile strength in wet tests is found to be particularly low in the absence of high concentrations of binder material. High binder concentrations, however, tend to mask or at least modify desired softness, water permeability and absorptivity characteristics of the nonwoven fabric.

A further difficulty arises from the fact that polyolefin fibers can vary considerably with respect to binder-wetting properties and also with respect to sensitivity to damage from heat curing. In this regard, polyolefin fibers such as polypropylene tend to be particularly sensitive to high curing temperatures and tend to lose valuable textural and absorption characteristics. A demand for binder concentrations in excess of about 40% by weight of fiber also acts adversely with respect to the latter properties.

It is an object of the present invention to develop a low temperature easily applicable binder system suitable for forming non woven fabrics from polyolefin-containing fiber webs.

It is a further object of this invention to increase the multidirectional strength of non-woven polyolefin-containing fabrics, particularly cross-directional strength, by utilizing an improved low temperature binder system.

Another object of the present invention is to prepare a non-woven polypropylene fabric having good cross-directional wet strength.

THE INVENTION

The above objects are achieved by development of a low temperature binder system for increasing the multidirectional strength of non-woven polyolefin-containing fabrics by contacting the corresponding fiber web with a binding amount of a low temperature binder system as described below, then drying and curing the treated web to obtain a fabric.

For purposes of the present invention a suitable low temperature binder system for non woven polyolefin fabrics comprises, in combination, (A) An essentially non-crosslinkable non crystalline polymer component of one or more of an ethylene/acrylic acid, styrene/lower alkyl acrylate, styrene/butadiene, ethylene/ethylacrylate, ethylene/vinyl acetate, and combination thereof with up to about 10 weight percent of acrylic or methacrylic acid as a third monomeric component to form the corresponding terpolymer. For purposes of the present invention, the lower alkyl substituents in the "A" latex component can vary from about 1–8 carbon atoms such as ethyl, butyl and octyl, and the monomeric ratios can usefully vary respectively as ethylene/acrylic acid (85/15–70/30), styrene/butyl acrylate (25/75–65/35), ethylene/vinylacetate (25/75–75/25), styrene. butadiene (30/70–70/30) and ethylene/ethyl acrylate (85/15–60/40), the corresponding terpolymers as above noted, additionally including up to about 10% by weight of binder of acrylic or methacrylic acid.

For purposes of the present invention the (A) component as above described, is utilized in the form of a latex or as an aqueous dispersion, depending on the particular combination of monomers utilized. In any case the desired latices are essentially non-crosslinkable; combined with.

(B) about 5–35 weight percent based on total binder solids, of a rosin ester dispersion of at least partially hydrogenated rosin with a polyhydric alcohol such as glycerol or pentaerythritol, the resulting ester component having an abietic acid concentration not exceeding about 2 weight percent, a drop softening point above about 70° C., inclusive of about 75° C.–115° C., and an average molecular weight not exceeding about 2000 and preferably between about 300–1000.

Suitable (A) component latices within the scope of the present invention, are conveniently obtained, for instance, by polymerization of the corresponding acrylic monomer, such as acrylic acid, methacrylic acid, ethyl acrylate, butyl acrylate, methyl methacrylate etc, or mixtures thereof with comonomers such as styrene, ethylene, propylene, butadiene and the like.

More specifically, suitable latices are conveniently obtained by preparing a polymerization mixture containing water, the appropriate monomers, a free-radical polymerization initiator such as potassium persulfate with up to 10% weight of anionic or nonionic emulsifying agents, with heating to a temperature of about 45°-90° C. until polymerization is completed. For general purposes adjustment to a slightly basic pH is preferred for subsequent combination with the rosin ester.

Latex material is conveniently obtained commercially for instance, as E-1610,-1830,-1715*, Gen. Flo3022; and PE 490*.

* Trademark of Rohm & Haas Company ST/BA-COOH
** Trademark of General Tire ST/BD/-COOH
*** Trademark of Dow Chemical Co.

In addition, dispersions of the (A) component can also conveniently contain other art-recognized additives such as defoaming agents, foaming agents, surfactants, dyes, pigments, and the like, in usual amounts.

Typically the rosin ester (i.e. "B" Component) for purposes of the present invention, is an emulsion of a hard resinous solid, the resin moiety preferably being about 60% to 100% hydrogenated. Such material is commercially available, in the solid form or as a dispersion. The solid form being identified, for instance, as Foral*, 85, or 105 (highly hydrogenated rosin/glycerol, MW 600-1000); Staybellite*/ester 10 (hydrogenated rosin/glycerine, MW 600-1000); Pentalyn ® H (hydrogenated rosin/pentaerythritol, MW 600-1000) and Piccotex ® ester resins such as LC and 75.

*Trademark of Hercules Incorporated

For general purposes a minimal amount of ester color is preferred, although the present invention is not limited to colorless ester components.

Polyolefin webs of polypropylene or polypropylene mixtures with other fibers such as polypropylene/-rayon, or with other synthetic or natural fibers can be conveniently wetted and bonded with the low temperature binder system of this invention. Because of the unique efficiency of the instant system, such fiber mixes can usually vary in content and weight throughout the entire range of mixtures and fabric weight can vary from about 10 gram/sq. yd. to about 40 gram/sq. yd. or higher.

For purposes of the present invention, the fiber dimension can usefully vary from about 1-40 denier/filament and 1"-4" length although not limited thereto; 1.5 denier X 1.5" being convenient for present purposes.

The invention is further illustrated by the following Examples, wherein parts and percentages are by weight unless otherwise specified.

EXAMPLE 1

Polypropylene staple fiber of 1.5 denier per filament and 1.5 inch cut length is carded into a web weighing about 12 g per square yard. This web is protected between sheets of paper to prevent distortion during handling, and die cut into 11"×14" specimens for preparation of bonded hand sheets. Web specimens are then transferred from paper protectors to fiberglass scrim for bonding.

In sample 1, a commercial modified acrylic latex identified as E1610** is diluted to 7% solids and used to saturate the web of polypropylene fibers. The web, in a scrim, is dipped into the diluted latex and passed between rubber nip rolls of a laboratory wringer to squeeze out excess latex. The wet web is transferred from the scrim to a Teflon film for drying in a forced air oven and cured, respectively, at 95° C. and 120° C. The dried and cured fabrics are cut into 1 inch wide strips for tensile testing on an Instron testing instrument using 5 inch gauge length and 2 inches per minute cross head speed. The wet strength determination is carried out in identical manner as the dry except that the test specimen in the Instron jaws, is brushed on both sides with a 0.5% solution of sodium dioctyl sulfosuccinate immediately prior to testing.

** Rohm & Hass Company

Sample 2 is prepared identically to Sample 1 except for the composition of latex used to saturate the web. The E1610** latex is blended with the aqueous dispersion of hydrogenated rosin ester (Foral 85) in a ratio respectively of 75/25 by dry weight, diluted to 7% solids.

The strips are tested for dry and wet cross directional strength as above described and results reported in Table 1 infra.

TABLE 1

| No. | Dried 95° C.*** | | Cured 120° C.*** | |
|---|---|---|---|---|
| | CDD* | CDW** | CDD | CDW** |
| 1 (Control) | 284 | 111 | 295 | 165 |
| 2 | 408 | 276 | 412 | 368 |

*Cross Direction Dry Strength (g/in.)
**Cross Direction Wet Strength (g/in.)
***10 minutes A difference between control and test samples with respect to both wet and dry strength of the non-woven fabrics is noted under both 95° C. and 120° C. drying and curing conditions.

EXAMPLE 2

Additional fiber samples (3-12) are prepared and tested as in Example 1, using the same ratio of premixed latex-to-rosin ester components but utilizing different latices. Test results are reported in Table 2 infra.

TABLE 2

| Sample No. | Acrylic Latex | Dried 10 min/ 95° C. | | Cured 10 min/ 120° C. | |
|---|---|---|---|---|---|
| | | CDD | CDW | CDD | CDW |
| 3 (Control) | E-1830 | 318 | 92 | 289 | 115 |
| 4 | E-1830 | 387 | 247 | 413 | 315 |
| 5 (Control) | E-1715 | 180 | 60 | 157 | 81 |
| 6 | E-1715 | 237 | 109 | 194 | 173 |
| 7 (Control) | Ethylene/Acrylic Acid 80/20 | 198 | 190 | 227 | 204 |
| 8 | Ethylene/Acrylic Acid 20/80 | 277 | 239 | 357 | 307 |
| 9 (Control) | Ethylene/vinyl acetate | 370 | 128 | 443 | 235 |
| 10 | Ethylene/vinyl acetate | 453 | 197 | 449 | 300 |
| 11 (Control) | Styrene/Butadiene | 165 | 77 | 141 | 81 |
| 12 | Styrene/Butadiene | 273 | 132 | 255 | 132 |

EXAMPLE 3

Polypropylene fabric samples identified as samples No. 13-15 are prepared and tested as in Example 2, except that the relative amount of rosin ester emulsion and latice is varied. The test results are reported in Table 3, infra.

TABLE 3

| Sample No. | Rosin Ester | Latex | Ester/Latex/ weight | Dried 95° C. CDD | Dried 95° C. CDW | Cured 120° C. CDD | Cured 120° C. CDW |
|---|---|---|---|---|---|---|---|
| 13 | Staybelite/ | E-1610 | 25/75 | 380 | 220 | 420 | 320 |
| | Ester 10 | | 15/85 | 377 | 200 | 380 | 230 |
| 14 | Pentalyn H | E-1610 | 25/75 | 330 | 249 | 420 | 340 |
| | | | 15/85 | 325 | 219 | 385 | 255 |
| 15 | Piccotex 75 | E-1610 | 25/75 | 370 | 291 | 376 | 332 |
| | | | 15/85 | 365 | 260 | 320 | 145 |

EXAMPLE 4

Polyproylene fabric is prepared as in Example 2 using Foral 85 as the hydrogenated glycerol ester of rosin and E 1610 as the acrylic latex. Test results are reported Table 4 infra.

TABLE 4

| Sample No | Ratio** (Latex/Ester) | Dried*/ 95° C. CDD | Dried*/ 95° C. CDW | Cured*/ 120° C. CDD | Cured*/ 120° C. CDW |
|---|---|---|---|---|---|
| 12 (Control) | 100/0 | 283 | 125 | 232 | 171 |
| 13 | 85/15 | 412 | 267 | 404 | 323 |
| 14 | 75/25 | 408 | 276 | 412 | 368 |
| 15 | 65/35 | 357 | 282 | 480 | 413 |
| 16 | 50/50 | 340 | 250 | 436 | 346 |
| 17 | 25/75 | 310 | 197 | 329 | 235 |
| 18 (Control) | 0/100 | 60 | 56 | 65 | 69 |

*10 minutes
**Dry solids

What is claimed is:

1. A low temperature binder system for non-woven polyolefin fabric consisting essentially of (A) essentially noncrosslinkable non-crystalline polymer of at least one component selected from the group consisting of
(a) ethylene/acrylic acid,
(b) styrene/butylacrylate,
(c) ethylene/vinylacetate, and
(d) at least one of (a), (b) or (c) in combination with an effective amount up to about 10 weight percent of acrylic or methacrylic acid; with (B) about 5–35 weight percent, based on total binder solids, of a rosin ester component of at least partially hydrogenated rosin with a polyhydric alcohol, the rosin ester component having an abietic acid concentration not exceeding about 2 weight percent, a drop softening point above about 70° C., and an average molecular weight not exceeding about 2,000.

2. A low temperature binder system for nonwoven polyolefin fabric consisting essentially of (A) styrene/butylacrylate (25/75–65/35) latex or ethylene/vinylacetate aqueous copolymer dispersion; and (B) about 5–35 weight percent, based on total binder solid, of a rosin ester dispersion of at least partially hydrogenated rosin with a polyhydric alcohol, the ester component having an abietic acid concentration not exceeding about 2 weight percent, a drop softening point above about 70° C. and a molecular weight range of about 300–1,000.

3. The binder system of claim 1, wherein the (B) component is a rosin ester having a drop softening point between about 75°–115° C.

4. The binder system of claim 1 wherein the (B) component has a molecular weight of about 300–1000.

5. The binder system of claim 1 wherein the (A) component is an ethylene/acrylic acid aqueous copolymer dispersion having a monomeric ratio of about 85/15–70/30 by weight of binder.

6. The binder system of claim 1 wherein the (A) component is a styrene/butylacrylate copolymer latex having a monomeric ratio of about 25/75–65/35 by weight of binder.

7. The binder system of claim 1 wherein the (A) component is an ethylene/vinyl acetate aqueous copolymer dispersion having a monomeric ratio of about 25/75–75/25 by weight of binder.

8. The binder system of claim 1 wherein the (A) component is a styrene/butadiene copolymer latex having a monomeric ratio of about 30/70 by weight of binder.

9. The binder system of claim 1 wherein the (B) component comprises a dispersion of at least one rosin ester with glycerol or pentaerythritol.

10. A method for increasing the multi-directional strength of nonwoven polyolefin-containing fabrics comprising contacting a corresponding fiber web with a binding amount of a lower temperature binder system comprising (A) An essentially non-crosslinkable non-crystalline polymer of at least one component selected from the group consisting of an ethylene/acrylic acid, styrene/lower alkyl acrylate, styrene/butadiene, ethylene/ethylacrylate, ethylene/vinyl acetate, and combination thereof with up to about 10 weight percent of acrylic or methacrylic acid as a third monomeric component; combined with (B) about 5–35 weight percent based on total binder solids, of a rosin ester dispersion of at least partially hydrogenated rosin with a polyhydric alcohol, the ester component having an abietic acid concentration not exceeding about 2 weight percent, a drop softening point above about 70° C., and an average molecular weight not exceeding about 2000; then drying and curing the treated fiber web to obtain a fabric.

11. A method for increasing the cross directional strength of a nonwoven polyolefin-containing fabric comprising contacting a fiber web with a binding amount of the low temperature binder system of claim 10, wherein the (B) component is a rosin ester having a drop softening point between 75° C.–115° C.

12. A method for increasing the cross directional wet strength of a nonwoven polyolefin-containing fabric comprising contacting a fiber web with a binding amount of the low temperature binder system of claim 10, wherein the (B) component has an average molecular weight of about 300–1000.

13. A method for increasing the cross directional wet strength of a nonwoven polyolefin-containing fabric comprising contacting a fiber web with a binding amount of the low temperature binder system of claim 12, wherein the (A) component is an ethylene/acrylic acid aqueous copolymer dispersion having a monomeric ratio of about 85/15–70/30 by weight of binder.

14. A method for increasing the cross directional wet strength of a nonwoven polyolefin-containing fabric comprising contacting a fiber web with a binding amount of the low temperature binder system of claim 12, wherein the (A) component is a styrene/butylacrylate copolymer latex having a monomeric ratio of about 25/75–65/35 by weight of binder.

15. A method for increasing the cross directional wet strength of a nonwoven polyolefin-containing fabric comprising contacting a fiber web with a binding amount of the low temperature binder system of claim 12, wherein the (A) component is an ethylene/vinyl acetate aqueous copolymer dispersion having a monomeric ratio of about 25/75–75/25 by weight of binder.

16. A method for increasing the cross directional wet strength of a nonwoven polyolefin-containing fabric comprising contacting a fiber web with a binding amount of the low temperature binder system of claim 12, wherein the (A) component is a styrene/butadiene copolymer latex having a monomeric ratio of about 30/70–70/30 by weight of binder.

17. A method for increasing the cross directional wet strength of a nonwoven polyolefin-containing fabric comprising contacting a fiber web with a binding amount of the low temperature binder system of claim 12 wherein the (A) component is an ethylene/ethylacrylate aqueous copolymer dispersion having a monomeric ratio of about 85/15–60/40 by weight of binder.

18. A method for increasing the cross directional wet strength of a nonwoven polyolefin-containing fabric comprising contacting a fiber web with a binding amount of the low temperature binder system of claim 14, wherein the (A) component additionally contains an effective amount up to about 10% by weight of binder of acrylic acid or methacrylic acid.

19. A method for increasing the cross directional wet strength of a nonwoven polyolefin-containing fabric comprising contacting a fiber web with a binding amount of the low temperature binder system of claim 15, wherein the (A) component additionally contains an effective amount up to about 10% by weight of binder of acrylic acid or methacrylic acid.

* * * * *

UNITED STATES PATENT AND TRADEMARK OFFICE

CERTIFICATE OF CORRECTION

PATENT NO. : 4,535,013

DATED : August 13, 1985

INVENTOR(S) : Beryl M. Kuhn

It is certified that error appears in the above-identified patent and that said Letters Patent is hereby corrected as shown below:

On the title page the following should be added:

--[73] Assignee: Hercules Incorporated
Wilmington, Delaware--.

Attorney, Agent or Firm should read --John E. Crowe--.

Signed and Sealed this

Nineteenth Day of November 1985

[SEAL]

Attest:

DONALD J. QUIGG

Attesting Officer

Commissioner of Patents and Trademarks